US009708941B2

(12) United States Patent
Kajiura et al.

(10) Patent No.: US 9,708,941 B2
(45) Date of Patent: Jul. 18, 2017

(54) VALVE TIMING CONTROL DEVICE OF INTERNAL COMBUSTION ENGINE

(71) Applicant: HITACHI AUTOMOTIVE SYSTEMS, LTD., Hitachinaka-shi, Ibaraki (JP)

(72) Inventors: Mikihiro Kajiura, Tama (JP); Yosuke Iwase, Yokohama (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 188 days.

(21) Appl. No.: 14/795,451

(22) Filed: Jul. 9, 2015

(65) Prior Publication Data

US 2016/0061066 A1 Mar. 3, 2016

(30) Foreign Application Priority Data

Aug. 28, 2014 (JP) ..... 2014-173699

(51) Int. Cl.
*F01L 1/34* (2006.01)
*F01L 9/04* (2006.01)
*F01L 1/344* (2006.01)

(52) U.S. Cl.
CPC ..... *F01L 9/04* (2013.01); *F01L 1/344* (2013.01); *F01L 2009/049* (2013.01)

(58) Field of Classification Search
CPC ..... F01L 9/04; F01L 1/344; F01L 2009/049
See application file for complete search history.

(56) References Cited

U.S. PATENT DOCUMENTS

2013/0180481 A1 7/2013 Kato et al.
2014/0137821 A1* 5/2014 Tadokoro ..... F01L 1/344 123/90.15

FOREIGN PATENT DOCUMENTS

JP 2013-036401 A 2/2013
JP 2013-147934 A 8/2013

* cited by examiner

*Primary Examiner* — Zelalem Eshete
(74) *Attorney, Agent, or Firm* — Foley & Lardner LLP

(57) ABSTRACT

A valve timing control device of internal combustion engine comprises a chain case 6 that is fixed to a cylinder head 101 of the engine and has a circular opening 55 for receiving therein a cylindrical housing 5*a* of an electric motor 8, an annular seal member 58 that is operatively received in an annular clearance defined between an outer cylindrical wall of the cylindrical housing 5*a* and an inner cylindrical wall of the circular opening 55, and a cover member 4 that is connected to the chain case 6 to cover the circular opening thereby concealing the annular seal member from the outside, wherein when the cover member 4 is removed from the chain case 6, the annular seal member 58 becomes exposed to the outside through the circular opening 55 of the chain case 6 for a visual inspection of the annular seal member.

12 Claims, 11 Drawing Sheets

VALVE TIMING CONTROL DEVICE OF INTERNAL COMBUSTION ENGINE

BACKGROUND OF THE INVENTION

1. Field of the Invention

The present invention relates to a valve timing control device of an internal combustion engine, which controls open/close timing of intake and/or exhaust valves of the engine.

2. Description of the Related Art

In order to clarify the features of the present invention, one known art in the field of the present invention, which is disclosed in Japanese Laid-open Patent Application (tokkai) 2013-36401, will be briefly described in the following.

The valve timing control device disclosed in the Japanese publication is of an electric type and generally comprises an electric motor whose cylindrical motor housing is integrally connected to a timing sprocket and a cup-shaped cover member that is arranged to cover a front part of the cylindrical motor housing. In an annular gap defined between a cylindrical inner surface of a stepped annular part formed on the cup-shaped cover member and an outer cylindrical surface of the cylindrical motor housing, there is disposed an annular oil seal.

The annular oil seal is constructed mainly from a synthetic rubber. Upon coupling of the oil seal with the annular gap, an outer solid rubber part (or base portion) of the annular oil seal is pressed onto the cylindrical inner surface of the stepped annular part, and at the same time an inner rubber part of the annular oil seal that includes an annular seal portion with a seal lip is slidably pressed onto the outer cylindrical surface of the cylindrical motor housing. The annular seal portion is biased toward the outer cylindrical surface of the motor housing by a back-up spring.

Because of provision of the annular oil seal arranged in the above-mentioned manner, the annular gap can be sealed and thus, any oil splashed by the timing sprocket is prevented from entering into the motor housing from a front side of the electric motor.

SUMMARY OF THE INVENTION

However, for the following reasons, the above-mentioned oil seal arrangement fails to exhibit a satisfied performance in assembling process thereof.

That is, when it is intended to mount the cup-shaped cover member to the front side of the electric motor, at first the annular oil seal is pressed axially into the stepped annular part of the cover member while being moved toward the front part of the cover member and then placed in a given position of the stepped annular part. Then, the cup-shaped cover member having the annular oil seal fixed thereto is moved axially toward the cylindrical motor housing causing the annular oil seal (more specifically, the seal lip of the oil seal) to axially slide on and along the outer cylindrical surface of the cylindrical motor housing. When then the cover member takes a right position relative to a chain case, the cover member is fixed to the chain case by using several connecting bolts.

However, once the cup-shaped cover member is mounted on the cylindrical motor housing, it becomes impossible to check the state and position of the annular oil seal by visual inspection from the outside. Actually, once the cup-shaped cover member is mounted on the cylindrical motor housing, the annular oil seal is concealed by a front construction of the cover member. Accordingly, if, at the time of coupling the cover member with the motor housing, the cover member is unstably handled and moved in a slanted state toward the cylindrical motor housing for coupling with the motor housing, undesired edge turning of the annular oil seal, which tends to occur, can't be inspected visually. Of course, in this case, the is such a possibility that due to defective sealing try the oil seal, the oil splashed by the timing sprocket is leaked into the motor housing.

It is therefore an object of the present invention to provide a valve timing control device of an internal combustion engine, which is free from the above-mentioned drawback.

According to the present invention, there is provided a valve timing control device of an internal combustion engine, in which an annular gap for receiving therein an annular oil seal is defined between a cylindrical inner surface of a chain case and a cylindrical outer surface of a cylindrical motor housing of an electric motor and the annular gap is placed at a front portion of the chain case to which a cover member is fixed. With this arrangement, the annular oil seal can be viewed by eyes of an assembling worker until the time when the cover member is finally fixed to the chain case. That is, the annular oil seal is kept exposed to the outside and the assembling worker until the cover member is finally fixed to the chain case. Of course, in this case, unstable condition of the annular oil seal in the gap is easily found by the assembling worker and easily corrected by him or her.

In accordance with a first aspect of the present invention, there is provided a valve timing control device of an internal combustion engine, which comprises first and second rotational members; a phase varying mechanism that varies a rotation phase of the second rotational member relative to the first rotational member; an electric motor mounted to the first rotational member; a speed reduction mechanism through which rotation of an output shaft of the electric motor is transmitted to the second rotational member while reducing the speed of the rotation; a cover member covering at least a part of the electric motor and fixed to a given element of the engine, the given element being either one of a cylinder head of the engine and a chain case; an annular seal member sealing an annular clearance between an outer cylindrical wall of the electric motor and the given element, the annular seal member being concealed by the cover member when the cover member is fixed to the given element, wherein the cover member is constructed and arranged to cause the annular seal member to be exposed to the outside for a visual inspection of the annular seal member when the cover member is removed from the given element.

In accordance with a second aspect of the present invention, there is provided a valve timing control device of an internal combustion engine, which comprises first and second rotational members; phase varying mechanism that varies a rotation phase of the second rotational member relative to the first rotational member thereby to change an operating characteristic of engine valves; an electric motor mounted to the first rotational member; a speed reduction mechanism through which rotation of an output shaft of the electric motor is transmitted to the second rotational member while reducing the speed of the rotation; a fixing member having a circular opening in which a cylindrical housing of the electric motor is inserted; a cover member covering one open side of the circular opening while concealing part of the electric motor; and an annular seal member having an outer annular part that is fixed to an inner cylindrical wall of the circular opening of the fixing member and an inner annular part that slidably contacts with an outer cylindrical wall of the cylindrical housing of the electric motor, wherein a diameter of the inner annular part of the annular seal member is smaller than a diameter of the one open side of the circular opening of the fixing member.

In accordance with a third aspect of the present invention, there is provided a valve timing control device of an internal combustion engine, which comprise intake and exhaust camshafts arranged to extend in parallel with each other; an electric type phase varying mechanism coaxially connected to the intake camshaft; and a hydraulic type phase varying mechanism coaxially connected to the exhaust camshaft, wherein the electric type phase varying mechanism comprises an intake side driving rotational member to which a torque of a crankshaft of the engine is transmitted; an intake side follower rotational member that is integrally connected to the intake shaft; an electric motor that is integrally mounted to the intake side driving rotational member and has a motor output shaft by which the intake side follower rotational member is rotated relative to the intake side driving rotational member; a fixing member having a circular opening in which a housing of the electric motor is received, the fixing member being arranged to cover at least part of the hydraulic type phase varying mechanism; a cover member that is connected to the fixing member in a manner to cover one open end of the circular opening of the fixing member; and an annular seal member sealing an annular clearance between an outer cylindrical wall of the housing of the electric motor and a cylindrical inner wall of the circular opening of the fixing member; wherein when the cover member is removed from the fixing member, the annual seal member is exposed to the outside through the open end of the circular opening of the fixing member for a visual inspection of the annular seal member.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
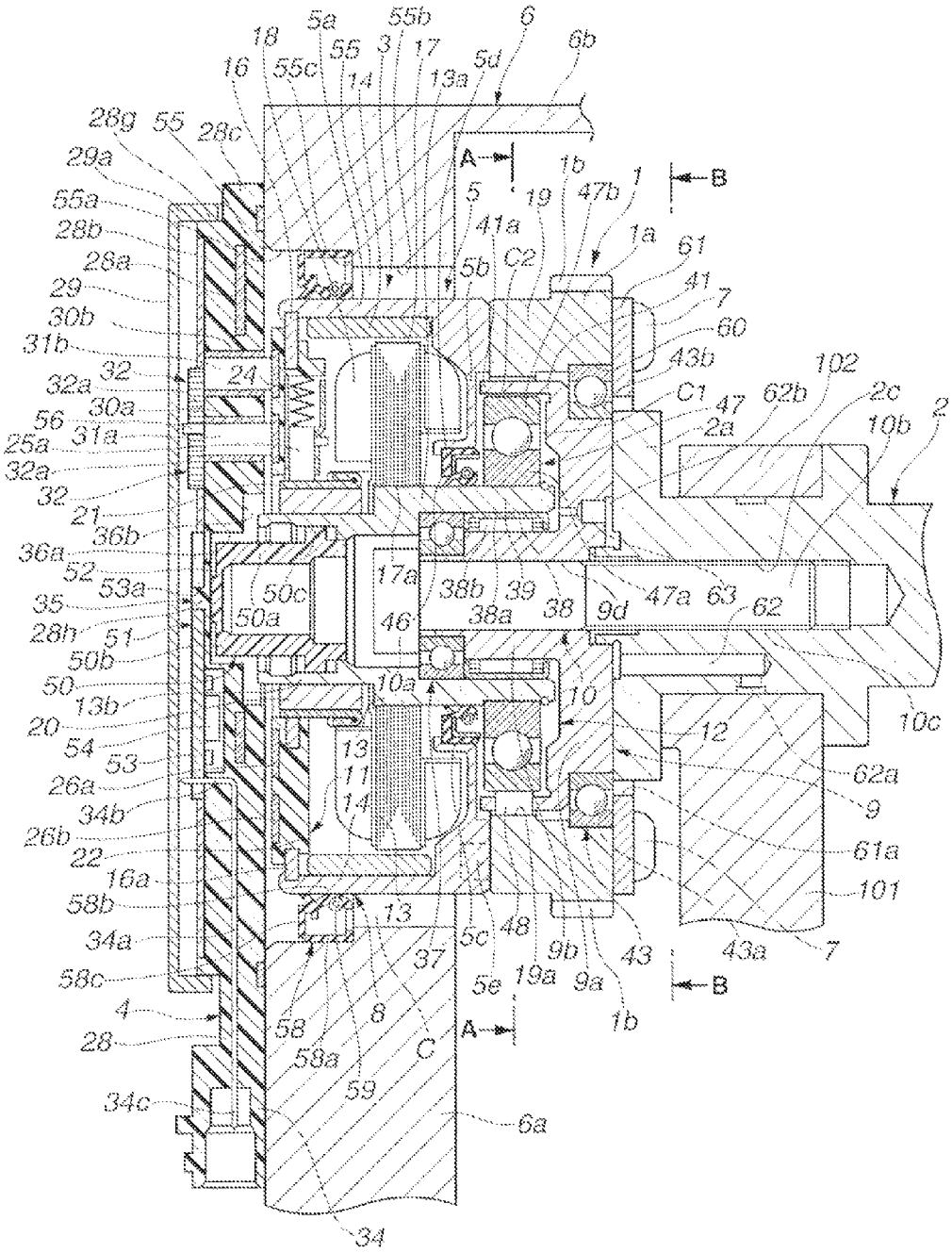
FIG. 1 is an enlarged sectional view taken along a line C-C of FIG. 2, showing a valve timing control device of a first embodiment of the present invention.
Figure 2:
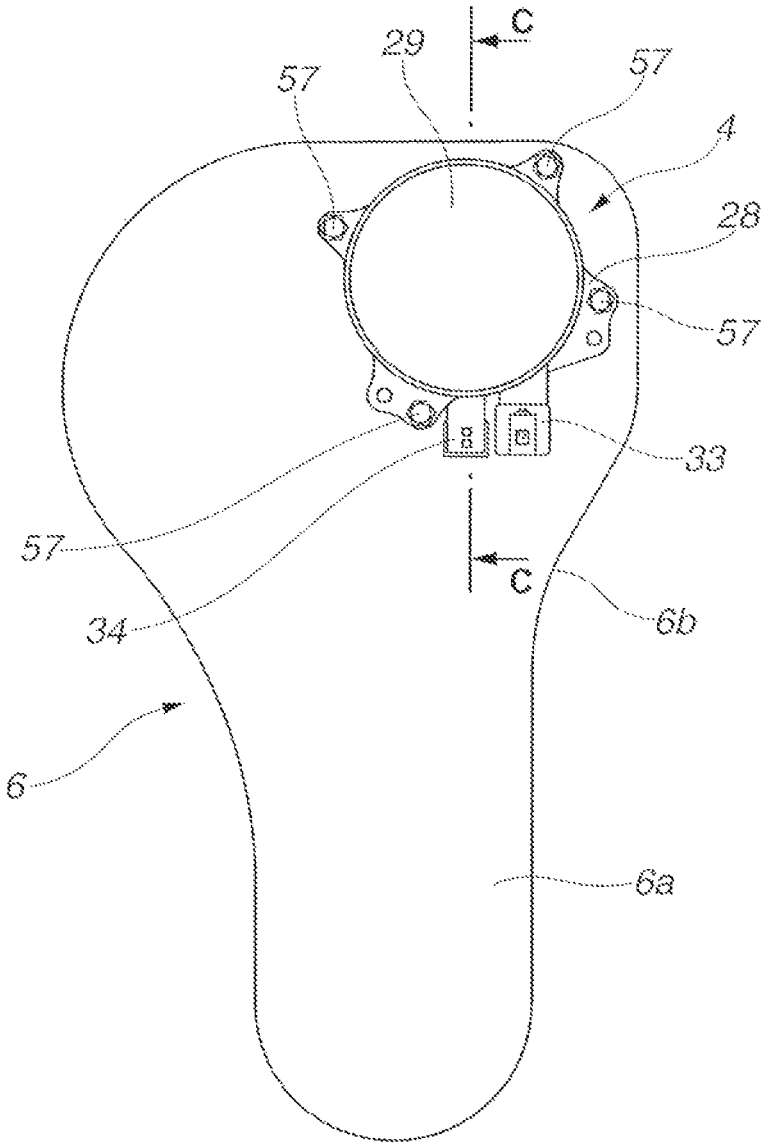
FIG. 2 is a front view of the valve timing control device of the first embodiment, showing a chain case and a cover member.

In the following, the valve timing control devices of the present invention will be described in detail with reference to the accompanying drawings.

First Embodiment

Referring to FIGS. 1 to 8, especially FIGS. 1 to 4, there is shown a value timing control device of a first embodiment of the present invention.

In this first embodiment, the present invention is practically applied to intake valves of an internal combustion engine for controlling the valve timing of the intake valves.

As is shown in FIGS. 1 to 4, the valve timing control device of the first embodiment is equipped with a timing sprocket 1 (first member) that is rotatably driven by a crank shaft (not shown), an intake camshaft 2 that is rotatably mounted on a cylinder head 101 through a bearing 102, rotatable relative to the timing sprocket 1 and rotatably driven by the timing sprocket 1, a phase varying mechanism 3 that is arranged between the timing sprocket 1 and the intake camshaft 2 to vary a relative rotation phase between the two members 1 and 2 in accordance with an engine operation condition, a cover member 4 that is arranged at a front side of the phase varying mechanism 3 and a chain case 6 that is fixed to both the cylinder head 101 and a cylinder block (not shown) to receive therein the timing sprocket 1 and some parts (such as an electric motor 8, a speed reduction mechanism 12, etc.,) of the phase varying mechanism 3.

Figure 4:
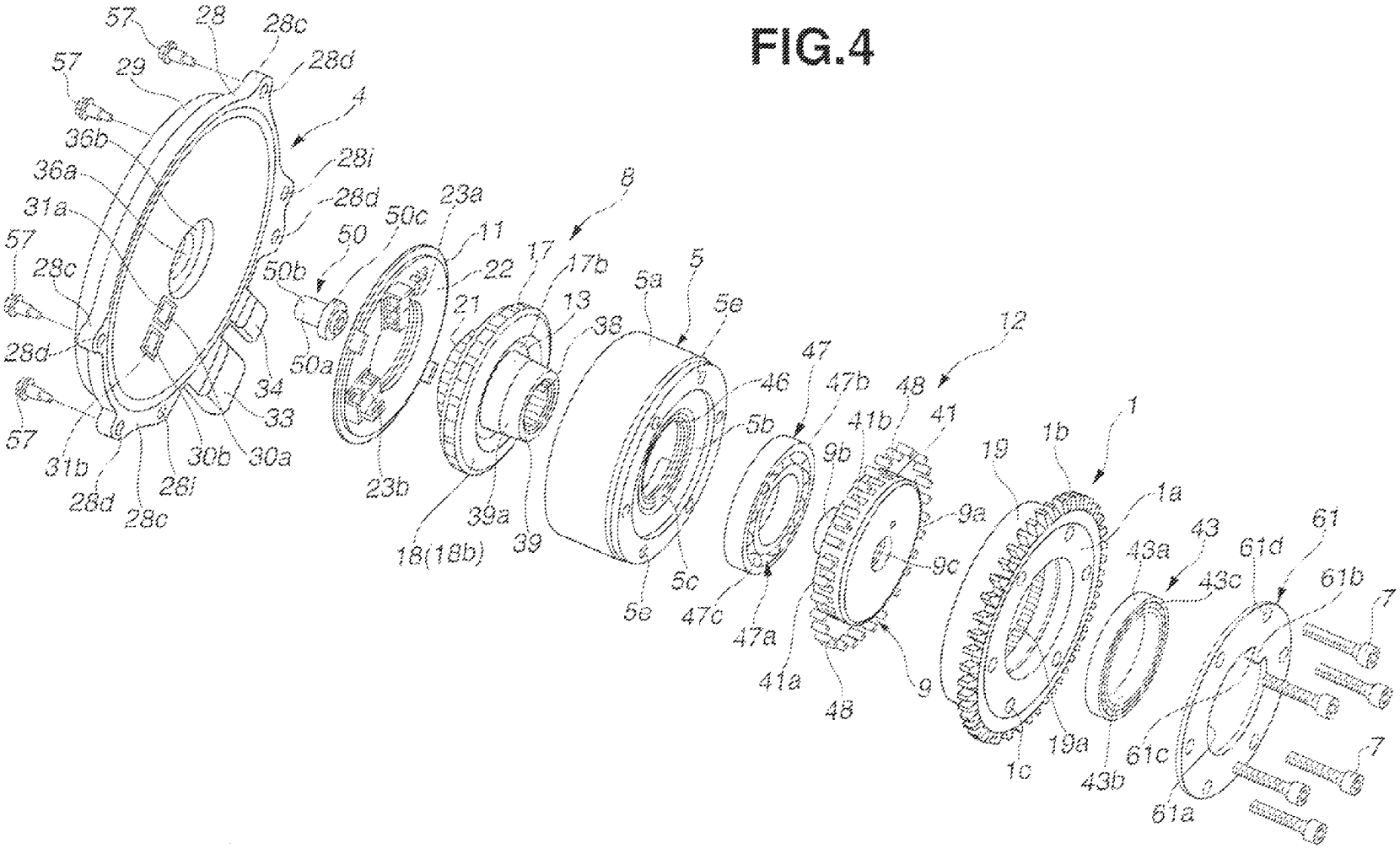
FIG. 4 is an exploded view of a unit including essential elements employed in the first embodiment of the present invention.

The timing sprocket 1 is an annular member entirely constructed of iron-based metal and as is seen from FIG. 4, comprises a sprocket body 1*a* that has a stepped inner cylindrical surface, a gear portion 1*b* that is integrally formed on an outer periphery of the sprocket body 1*a* and engaged with a timing chain (not shown) to receive a rotation power (or torque) from the crank shaft and an internal gear construction 19 that is integrally formed on a front end of the sprocket body 1*a*.

Between the sprocket body 1*a* and an after-mentioned follower member 9 (or second member) provided at a front end of the intake camshaft 2, there is disposed a larger diameter ball bearing 43 for smoothing the relative rotation between the timing sprocket 1 and the intake camshaft 2.

The larger diameter ball bearing 43 is of a conventional type comprising an outer race 43*a*, an inner race 43*b* and balls 43*c* rotatably received between the outer and inner races 43*a* and 43*b*. Upon assembly, as is seen from FIG. 1, the outer race body 1*a* and the inner race 43*b* is press-fitted to the outer cylindrical wall of the follower member 9.

As is seen from FIG. 1, the sprocket body 1*a* is formed at its inner cylindrical wall with an annular groove (or outer race fixing portion) 60 that faces toward the intake camshaft 2. As shown in the drawing, the annular groove 60 has the outer race 43*a* of the bearing 43 axially press-fitted thereto. Due to provision of a stepped wall of the annular groove 60, an axial positioning of the outer race 43*a* is achieved.

As is seen from FIG. 4, the internal gear construction 19 of the timing sprocket 1 is cylindrical in shape and integrally formed on the front end of the sprocket body 1*a*. As shown in FIG. 1 the internal gear construction 19 projects toward a front part of the phase varying mechanism 3. The internal gear construction 19 is formed at its inner cylindrical wall with a plurality of wave-form teeth 19*a*.

As is seen from FIGS. 1 and 4, behind the timing sprocket 1, there is arranged annular holding plate 61 of metal.

Figure 6:
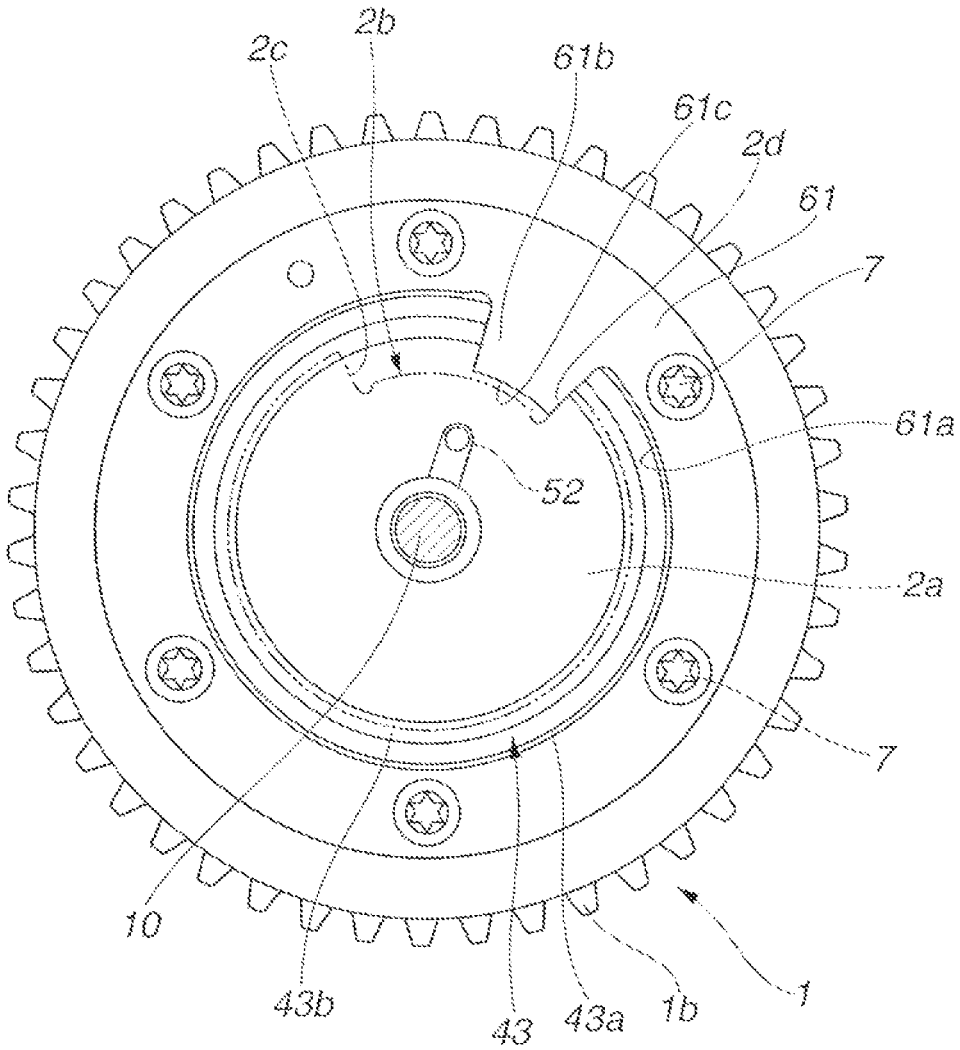
FIG. 6 is a sectional view taken along the line B-B of FIG. 1.

As is seen from FIGS. 1 and 6, the outer diameter of the annular holding at 61 is substantially the same as that of the sprocket body 1*a*, and the inner diameter of the annular holding plate 61 is smaller than the outer diameter of the outer race 43*a* of the larger diameter ball bearing 43.

As shown in FIG. 1, an inner peripheral part 61*a* of the annular holding plate 61 is in contact with a rear end of the outer race 43*a* of the ball bearing 43. As shown in FIG. 4, the inner peripheral part 61*a* of the annular holding plate 61 is formed with an inwardly projected stopper 61*b*.

As is seen from FIG. 6, the projected stopper 61*b* is shaped like a fan and has at its top a curved edge 61*c* that curves along a curved bottom of an after-mentioned stopper groove 2*b*.

As is seen from FIGS. 1 and 6, the annular holding plate 61 as well as the sprocket body 1*a* of the timing sprocket 1 are each formed with equally spaced six bolt holes 61*d* or 1*c* through which respective connecting bolts 7 are passed.

As will be described hereinafter, the sprocket body 1*a* and the internal gear construction 19 constitute a casing for the speed reduction mechanism 12.

As is seen from FIGS. 1 and 4, a motor housing 5 of the electric motor 8 is equipped with a cylindrical housing body 5*a* that is bottomed and produced by pressing an iron-based metal plate and a power feeding plate 11 that hermetically covers a front open end of the housing body 5*a*.

The housing body 5*a* is provided at its rear end with a circular partition wall 5*b*. The circular partition wall 5*b* is formed at its generally center part with a larger diameter circular opening 5*c* through which an after-mentioned eccentric shaft part 39 is passed.

As is seen from FIG. 1, an inner periphery of the circular opening 5*c* is integrally formed with a cylindrical projection 5*d* that projects axially leftward in FIG. 1. As is seen from FIG. 4, the circular partition wall 5*b* of the motor housing 5 is formed with equally spaced six threaded holes 5*e*. It is to be noted that upon assembly, the above-mentioned internal gear construction 19 of the timing sprocket 1 is in contact with a rear end surface of the partition wall 5*b* of the housing body 5*a*.

As will be understood from FIG. 4, upon assembly, the six connecting bolts 7 are respectively inserted into the threaded bolt holes of the motor housing 5 through the bolt holes 61*d* of the annular holding plate 61 and the bolt holes 1*c* of the timing sprocket 1 and then the connecting bolts 7 are fastened to the motor housing 5.

As will be seen from FIGS. 1 and 4, the diameter of sprocket body 1*a* is generally the same as those of the internal gear construction 19 of the timing sprocket 1, the annular holding plate 61 and the housing body 5*a* of the motor housing 5.

Although not shown in the drawings, the intake camshaft 2 is equipped with two drive cams for each cylinder to induce an open operation of the intake valves.

As shown in FIG. 1, the intake camshaft 2 is formed at its front end with a flange part 2*a*. As seen from this drawing, the outer diameter of the flange part 2*a* is somewhat larger than that of an after-mentioned fixing end portion 9*a* of the follower member 9. Thus, upon assembly, the outer peripheral portion of the flange part 2*a* is in contact with a rear side of the inner race 43*b* of the larger diameter ball bearing 43 and at the same time, the front end surface of the flange part 2*a* is in contact with a rear end surface of the follower member 9 as shown. Designated by numeral 10 in FIG. 1 is a cam bolt by which the flange part 2*a* is secured to the follower member 9.

As is seen from FIG. 6, the flange part 2*a* is formed at its peripheral portion with a curved stopper recess 2*b* that extends around the center of the flange part 2*a*. Upon assembly, curved stopper recess 2*b* receives the above-mentioned inwardly projected stopper 61*b* of the annular holding plate 61 as shown. That is, the curved stopper recess 2*b* has a given length in a circumferential direction so that the projected stopper 61*b* of the annular holding plate 61 moves between circumferentially opposed ends 2*c* and 2*d* of the stopper recess 2*b* together with a rotating movement of the annular holding plate 61. That is, when the projected stopper 61*b* contacts the end 2*c* of the stopper recess 2*b*, the intake camshaft 2 assumes the most retarded rotation phase relative to the timing sprocket 1.

As will be understood from FIGS. 1 and 4, the projected stopper 61*b* of the annular holding plate 61 is positioned apart rightward in FIG. 1 from the rear side of the outer race 43*a* of the larger diameter ball bearing 43, so that the projected stopper 61*b* does not contact the fixing end portion 9*a* of the follower member 9. Accordingly, undesired interference between the projected stopper 61*b* and the fixing end portion 9*a* can be suppressed.

As is seen from FIG. 1, an enlarged head portion 10*b* of the cam bolt 10 is formed at its right portion with a male thread 10*c* that is engaged with a female thread 2*e* formed on a cylindrical wall of an axial hole formed in the intake camshaft 2.

The follower member 9 is constructed of iron-based metal and as is seen from FIG. 1, comprised the fixing end portion 9*a* that is circular in shape, a tubular portion 9*b* that projects forward from a center portion of the circular fixing end portion 9*a* and a cylindrical holding part 41 that projects forward from an outer peripheral portion of the circular fixing end portion 9*a*. As will become apparent as the description proceeds, the cylindrical holding part 41 functions to hold a plurality of rollers 48. As is seen in FIG. 4, the cylindrical holding part 41 is formed with a plurality of roller receiving openings (no numeral) for rotatably receiving the rollers 48. In FIG. 4 the rollers 48 are viewed as if the rollers 48 are arranged outside the apertured cylindrical holding part 41. However, upon assembly, the rollers 48 are neatly put in the roller receiving openings respectively.

As is seen from FIG. 1, the circular fixing end portion 9*a* has a rear end surface that is in contact with a front end surface of the flange part 2*a* of the intake camshaft 2. Due to connecting force produced by the cam bolt 10, the circular fixing end portion 9*a* is secured to the front end surface of the flange part 2*a*, and thus, the intake camshaft 2 and the follower member 9 rotate together like a single member.

As is seen from FIG. 1, a through bore 9*b* formed in the tubular portion 9*b* of the follower member 9 receives therein the shaft part 10*b* of the cam bolt 10. Around the tubular portion 9*b*, there are arranged a plurality of needle bearing 38.

As is seen from FIG. 1, the cylindrical holding part 41 of the follower member 9 projects forward from an outer peripheral portion of the circular fixing end portion 9*a*.

A front portion 41*a* of the cylindrical holding part 41 projects toward the circular partition wall 5*b* of the motor housing 5 through a cylindrical space defined by the internal gear construction 19 and the circular partition wall 5*b*.

Figure 5:
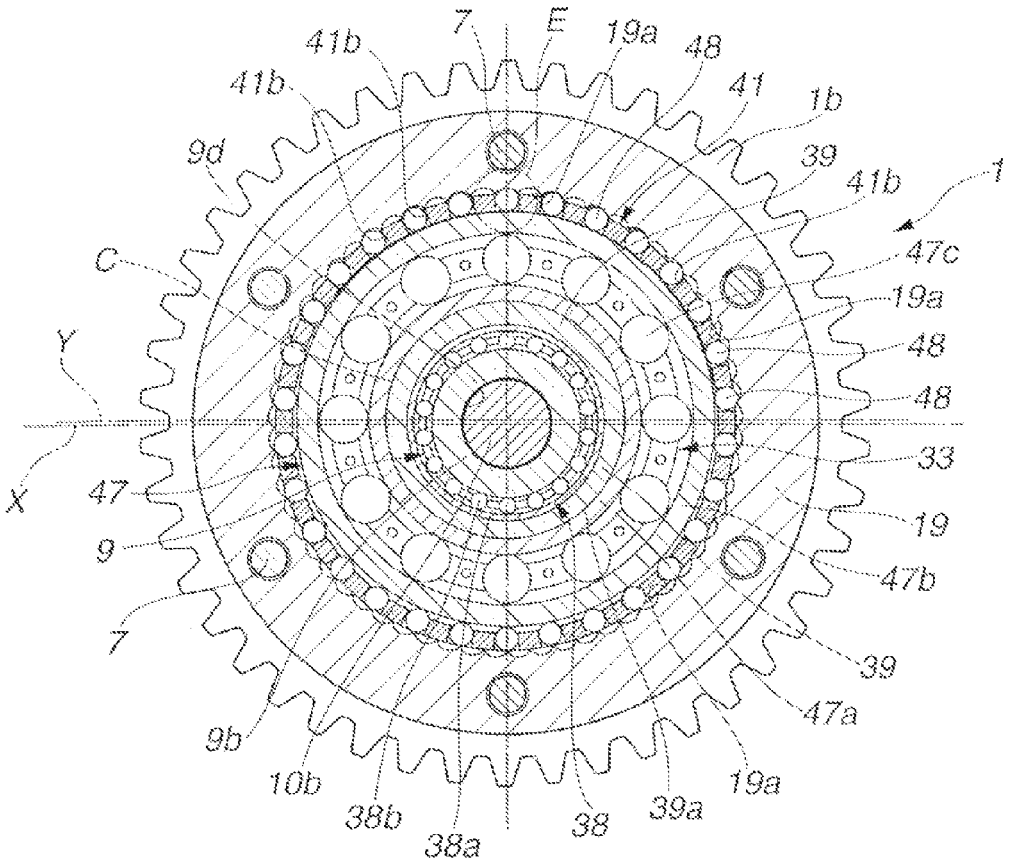
FIG. 5 is a sectional view taken along the line A-A of FIG. 1.

As is seen from FIGS. 1, 4 and 5, the cylindrical front portion 41*a* is formed at evenly spaced peripheral portions thereof with a plurality of roller holding holes 41*b*. As will be understood from FIGS. 1 and 4, the roller holding holes 41*b* rotatably hold the rollers 48 respectively. As is seen from FIG. 4, each roller holding hole 41*b* is rectangular in shape and has front and rear ends closed. The number of the roller holding holes 41*b* is smaller than that of the wave form teeth 19*a* of the internal gear construction 19. With this difference in number between the holes 41*b* and teeth 19*a*, a speed reduction from the timing sprocket 1 to the follower member 9 is achieved.

As be understood from FIGS. 1, 4 and 5, the phase varying mechanism 3 mainly comprises the electric motor 8 that is arranged at a front side of the tubular portion 9*b* of the follower member 9 and the speed reduction mechanism 12 that transmits the rotation of the electric motor 8 while reducing the speed of the rotation.

As is seen from FIG. 4, the electric motor 8 is of a DC brush motor, and comprises the motor housing (or yoke) 5 that rotates together with the timing sprocket 1, an output shaft 13 that is rotatably installed in the motor housing 5, four arcuate permanent magnets 14 that are secured or bonded to equally spaced portions of a cylindrical inner wall of the motor housing 5 and the power feeding plate 11 that is fixed to a front end of the motor housing 5.

The output shaft 13 has a stepped tubular shape and functions as an armature, and as is seen from FIG. 1, the output shaft 13 comprises a larger diameter portion 13*a* that extends from the stepped part toward the intake camshaft 2 and a smaller diameter portion 13*b* that extends from the stepped part toward the cover member 4. Around and on the larger diameter portion 13*a*, there is tightly disposed a rotor core 17, and a rear end part of the larger diameter portion 13*a* constitutes an eccentric shaft portion 39 that forms part of the speed reduction mechanism 12.

As is seen from FIG. 1, around and on the smaller diameter portion 13*b*, there is tightly disposed an annular member 20. An after-mentioned commutator 21 is tightly disposed on the annular member 20. As is seen from FIG. 1, the outer diameter of the annular member 20 is generally the same as that of the larger diameter portion 13*a*, and the annular member 20 is placed on a generally middle part of the smaller diameter portion 13*b*.

The rotor core 17 is constructed of a plurality of magnetic plates with magnetic poles. An outer peripheral part of the rotor core 17 is constructed to have bobbins around which wires of coils 18 are wound. The rotor core 17 is tightly disposed on and around the larger diameter portion 13*a* of the output shaft 13 near the stepped part.

The commutator 21 is annular in shape and constructed of a conductive material. The commutator 21 is divided into a plurality of segments that are electrically connected to the wires of the coils 18 respectively. The number of the segments is the same as that of the magnetic poles of the rotor core 17.

The four arcuate permanent magnets 14 are arranged in a circumferential direction leaving even space between adjacent magnets 14, and thus the four arcuate permanent magnets 14 have a plurality of magnetic poles in the circumferential direction. As shown in FIG. 1, the unit of the permanent magnets 14 is offset toward the power feeding plate 11 relative to the rotor core 17. With this arrangement, front end portions of the permanent magnets 14 are arranged to be overlapped with after-mentioned switching brushes 24*a* and 25*b* mounted to the commutator 21 and the power feeding plate 11.

As seen from FIGS, 1 and 7, the power feeding plate 11 comprises a circular metal plate portion 16 that is constructed of an iron-based metal and a molded circular resin portion 22 that is applied to front and rear surfaces of the circular metal plate portion 16.

Figure 7:
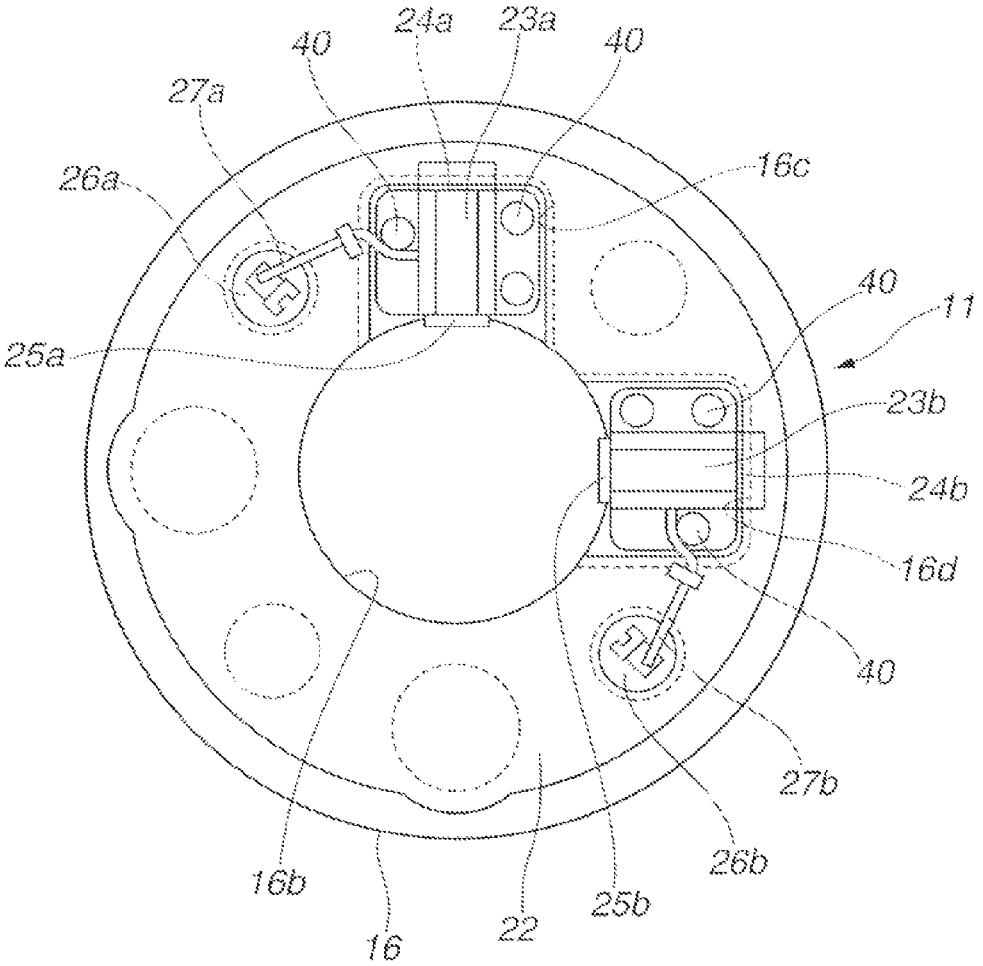
FIG. 7 is a rear view of a power feeding plate employed in the first embodiment of the present invention.

As is understood from FIGS. 1 and 7, the circular metal plate portion 16 has an outer peripheral part 16*a* that is not covered by the resin portion 22. The outer peripheral part 16*a* is gripped by a front end of the motor housing 5. For this gripping, the front end of the motor housing 5 has at its inner wall an annular groove for receiving the outer peripheral part 16*a* of the metal plate portion 16, and a caulking technique is used for the gripping.

As is seen from FIG. 7, the circular power feeding plate 11 is formed at its center part with a circular opening 16*b* through which the smaller diameter portion 13*b* of the motor output shaft 13 passes. Furthermore, the circular power feeding plate 11 is formed at positions near the circular opening 16*b* with two rectangular holding openings 16*c* and 16*d* each being connected to the circular opening 16*b* as shown. As will be described in detail in the following, brash holders 23*a* and 23*b* are put in and held by the holding openings 16*c* and 16*d*.

As is seen from FIGS. 1 and 7, particularly FIG. 7, each brash holder 23*a* or 23*b* is cylindrical in shape and constructed of copper material, and each brash holder 23*a* or 23*b* is positioned inside the holding opening 16*c* or 16*d* and secured to a front part 22*a* of the molded circular resin portion 22 by means of three rivets 40. A switching brush 25*a* or 25*b* is slidably received in the cylindrical brash holder 23*a* or 23*b* and biased toward a cylindrical outer surface of the commutator 21 by means of a coil spring 24*a* or 24*b*. With this, a domed leading end of each switching brush 25*a* or 25*b* is pressed against the cylindrical outer surface of the commutator 21.

As is seen from FIG. 1, smaller and larger slip rings 26*a* and 26*b* of copper material are concentrically disposed on the front part 22*a* of the molded circular resin portion 22 of the circular power feeding plate 11. As is seen from FIG. 7, the smaller and larger slip rings 26*a* and 26*b* are connected to the switching brushes 25*a* and 25*b* through respective harnesses 27*a* and 27*b*.

Figure 3:
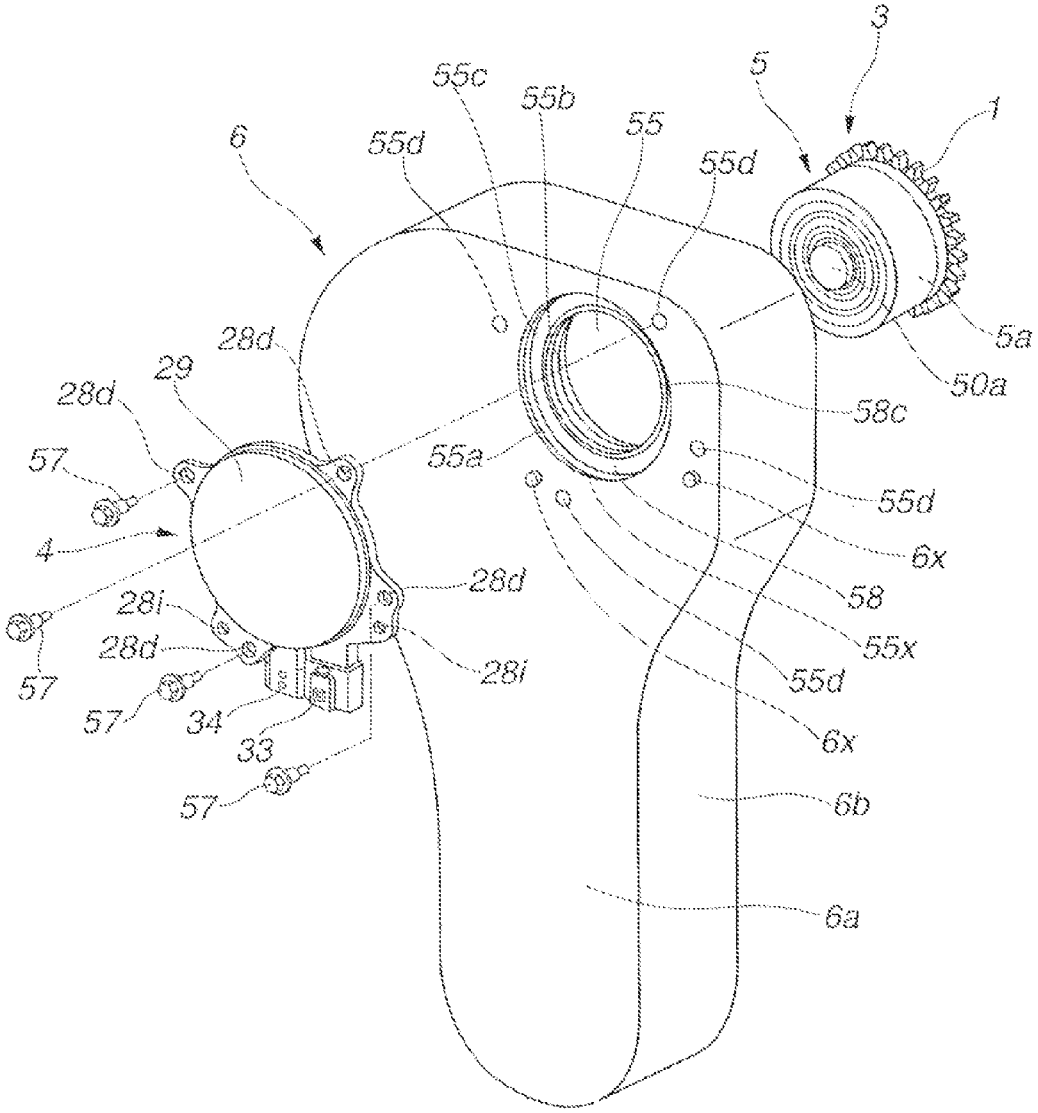
FIG. 3 is an exploded view of a unit including the chain case, the cover member and a phase varying mechanism.

As is seen from FIG. 3, the cover member 4 is shaped circular and arranged to cover a circular opening 55 formed at an upper part of a thicker front wall 6*a* of the chain case 6. For the arrangement of the cover member 4 onto the chain case 6, four connecting bolts 57 are used. As is seen from FIG. 4, the cover member 4 comprises a circular cover body 28 of resin and a cover part 29 of resin covering a front wall of the circular cover body 28.

As is seen from FIG. 4, the circular cover body 28 has a given thickness and has an outer diameter larger than that of the housing body 5*a* of the motor housing 5. As is seen from FIG. 1, the circular cover body 28 has a reinforcing metal plates 28*a* embedded therein.

Figure 8:
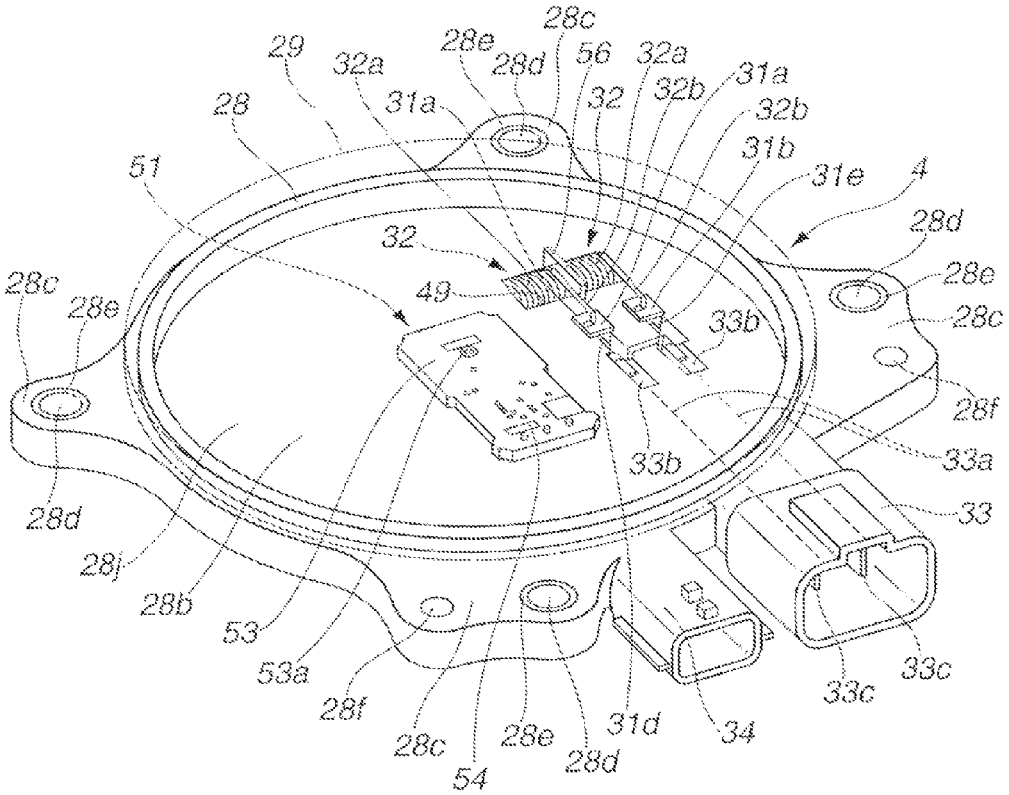
FIG. 8 is a perspective view of the cover member employed in the first embodiment of the present invention.

As is best seen from FIG. 4, the circular cover body 28 has at its peripheral portion four boss parts 28*c* each having a bolt hole 28*d* reinforced with a metal sleeve 28*e* (see FIG. 8). As is seen from FIG. 3, each connecting bolt 57 is passed through the bolt hole 28*d* and tightly engaged with a threaded hole 55*d* provided in the front wall 6*a* of the chain case 6.

As is seen from FIG. 8, two of the boss parts 28*c* have further pin receiving holes 28*f* through which positioning pins (not shown) are passed when the cover member 4 is fixed to the chain case 6.

As is seen from FIG. 1, the cover part 29 of the cover member 4 has an outer peripheral portion 29*a* that is tightly fitted to an annular groove 28*g* formed on an outer peripheral portion of the circular cover body 28.

As is seen from FIGS. 1 and 4, the circular cover body 28 is provided with a pair of brush holders 30*a* and 30*b* of copper at positions that face the above-mentioned smaller and larger slip rings 26*a* and 26*b* provided on the front part 22*a* of the molded circular resin portion 22. Within the brush holders 30*a* and 30*b*, there are axially slidably received power feeding brushes 31*a* and 31*b* each having a leading end that slidably contacts with the smaller or larger slip ring 26*a* or 26*b*. The positioning of the power feeding brushes holders 31*a* and 31*b* relative to the cover member 4 and the molded circular resin portion 22 is well understood from FIG. 4.

As is seen from FIG. 4, the circular cover body 28 is formed at its center part with a circular opening with an annular groove 36*a*. An inner diameter of the annular groove 36*a* is larger than an outer diameter of a leading end part 50*b* of a detected unit 50, and the depth of the annular groove 36*a* is slightly smaller than the thickness of the circular cover body 28. That is, the center opening of the circular cover body 28 is a bottomed hole. As is seen from FIG. 1, the bottom of this bottomed hole is formed with a positioning stub 28*h* that is tightly put in a hole formed in an after-mentioned detecting unit 51.

As is seen from FIG. 8, the circular cover body 28 is formed with a rectangular holding groove 49 at a position near the feeding brushes 31*a* and 31*b*. Within the rectangular holding groove 49, there are received a pair of coil springs 32 and 32 for biasing the feeding brushes 31*a* and 31*b* toward the slip rings 26*a* and 26*b*. Each coil spring 32 has a coiled part 32*a* received in the rectangular holding groove 49. Although not shown in the drawing, a retainer bar extending in and along the holding groove 19 is passed through the coiled part 32*a* thereby a suppress the coiled part 32*a* from disengaging from the holding groove 49. More specifically, the retainer bar has at its middle portion a support piece 56 integrally connected thereto. As shown, upon assembly, the support piece 56 is press-fitted to a slit (no numeral) formed in the circular cover body 28, so that the two coil springs 32 and 32 are entirely received in the holding groove 49. It is to be noted that an outside end of each coil spring 32 is held by a slit (not shown) formed in the retainer bar.

Each coil spring 32 has an elongate inside arm 32*b* whose bent top is pressed against a rear end of a corresponding one of the feeding brushes 31*a* and 31*b*, as shown. With this, tops of the feeding brushes 31*a* and 31*b* are pressed against the smaller and larger slip rings 26*a* and 26*b*.

As will be understood from FIGS. 1 and 4, each brush holder 30*a* or 30*b* has front and rear open ends, and as is seen from FIG. 1, upon assembly, the tops of the feeding brushes 31*a* and 31*b* are exposed from the rear open ends of the brush holders 30*a* and 30*b* pressed on the smaller and larger slip rings 26*a* and 26*b* respectively.

As shown in FIG. 8, to rear ends of the feeding brushes 31*a* and 31*b*, there are connected one ends of pig-tail harnesses 31*d* and 31*e*. The other ends of the pig-tail harnesses 31*d* and 31*e* are connected to ends 33*b* and 33*b* of terminal members 33*a* and 33*a* of a power feeding connector 33. It is to be noted that the length of each pig-tail harness 31*d* or 31*e* is so set as to prevent the pig-tail harness 31*d* or 31*e* from disengaging from the brush holder 30*a* or 30*b*.

As is well seen from FIG. 4, the power feeding connector 33 is integrally provided at a lower part of the circular cover body 28. Through the power feeding connector 33, a current from a battery (not shown) is led to the power feeding brushes 31*a* and 31*b*. Actually, the current fed to the power feeding brushes is controlled by a control unit (not shown). At the lower part of the circular cover body 28, there is further provided a signal connector 34 through which a rotation angle representing signal produced by an after-mentioned rotation angle detecting device is led to the control unit.

As is seen from FIG. 8, the power feeding connector 33 has therein a rectangular parallelopiped space that extends outward along a radial direction of the cover member 4. The terminal members 33*a* and 33*a* are embedded in the circular cover body 28 of resin, and have one ends 33*b* and 33*b* connected to the pig-tail harnesses 31*d* and 31*e* and the other ends 33*c* and 33*c* that are exposed to the rectangular parallelopiped space of the power feeding connector 33. Although not shown in the drawing, the other ends 33*c* and 33*c* are male terminals that are to be connected to female terminals that are lead to the control unit.

As is seen from FIG. 1, between the smaller diameter portion 13*b* of the motor output shaft 13 and a bottom wall of the annular groove 36*a* of the circular cover body 28, there is arranged a rotation angle sensor 35 that detects a rotation angle position of the motor output shaft 13.

This rotation angle sensor 35 is of an electromagnetic induction type and as is seen from FIG. 1 comprises the detected unit 50 that is fixed to the interior of the smaller diameter portion 13*b* of the motor output shaft 13 and a detecting unit 51 that is fixed to a generally central portion of the circular cover body 28 for receiving a detecting signal from the detected unit 50.

The detected unit 50 comprises a honewort-shaped rotor 52 that is fixed to a bottom wall of a bottomed cylindrical member 50*a* of resin and an annular projection 50*c* that is integrally formed on the bottomed cylindrical member 50*a* and press-fitted in the smaller diameter portion 13*b* of the motor output shaft 13.

As shown, an outer diameter of the bottomed cylindrical member 50*a* is smaller than an inner diameter of the above-mentioned annular groove 36*a*, and a leading portion 50*b* projecting from the smaller diameter portion 13*b* of the motor output shaft 13 is received in the annular groove 36*a* of the circular cover body 28 leaving an annular clearance therebetween. As shown, between the honewort-shaped rotor 52 fixed to the bottomed cylindrical member 50*a* and the bottom wall of the annular groove 36*a*, there is defined a fine clearance.

As is seen from FIG. 8, the detecting unit 51 comprises a rectangular printed wiring board 53 that is arranged on a generally center position of the circular cover body 28 of the cover member 4, an integrated circuit (ASIC) 54 that is mounted on one end of the printed wiring board 53 and transmitting and receiving circuits (not shown) that are mounted on the other end of the printed wiring board 53.

The printed wiring board 53 is formed with a positioning hole 53*a* at a position between the transmitting and receiving circuits. As will be understood from FIG. 1, upon assembly, the above-mentioned positioning stub 28*h* of the circular cover body 28 is press-fitted into the positioning hole 53*a* of the printed wiring board 53. With this, the honewort-shaped rotor 52 and the detecting unit 51 are suitably positioned.

Referring back to FIG. 8, the printed wiring board 53 is fixed to the front surface of the cover body 28 by connecting bolts or the like. Accordingly, as will be understood from FIG. 1, upon assembly, the transmitting and receiving circuits on the printed wiring board 53 are arranged to face the honewort-shaped rotor 52 leaving a fine clearance therebetween.

Accordingly, when the honewort-shaped rotor 52 on the bottomed cylindrical member 50*a* is rotated about its axis upon rotation of the motor output shaft 13, an individual current is produced between the transmitting and receiving circuits and the rotor 52. By this electromagnetic induction action, the integrated circuit 54 detects a rotation speed of the motor output shaft 13, which is led to the control unit in a form of an electric signal.

As is seen from FIG. 1, the circular cover body 278 of the cover member 4 is formed with a larger diameter groove 36*b* that surrounds the bottomed cylindrical member 50*a*.

It is to be noted that the annular grooves 36*a* and 36*b* constitute a so-called labyrinth groove.

The motor output shaft 13 and the eccentric shaft part 39 are rotatably supported by both the smaller diameter ball bearing 37 mounted on the shaft part 10*b* of the cam bolt 10 and the needle bearing 38 mounted on the tubular portion 9*b* of the follower member 9. As shown, the smaller diameter ball bearing 37 and the needle bearing 38 are coaxially arranged.

The needle bearing 38 comprises a cylindrical bearing retainer 38*a* that is tightly received in a cylindrical inner wall of the eccentric shaft part 39 and a plurality of needle rollers 38*b* that are rotatably received in an annular space defined between the cylindrical bearing retainer 38*a* and the tubular portion 9*b* of the follower member 9.

The smaller diameter ball bearing 37 comprises an inner race (no numeral) that is tightly disposed between a front end of the tubular portion 9*b* of the follower member 9 and the head portion 10*a* of the cam bolt 10, an outer race (no numeral) that is tightly received in the inner cylindrical wall of the eccentric shaft part 39 and a plurality of balls (no numeral) that are rotatably received between the inner and outer races.

As is seen from FIG. 1, between the outer cylindrical surface of the eccentric shaft part 39 of the motor outer shaft 13 and an inner cylindrical surface of the cylindrical projection 5*d* of the motor housing 5, there is disposed an annular oil seal 46 for preventing an oil leakage from an interior of the speed reduction mechanism 12 to an interior of the electric motor 8. That is, the annular oil seal 46 functions to protect the electric motor 8 from lubrication oil operatively used in the speed reduction mechanism 12.

The above-mentioned control unit detects a current engine operation condition by processing various information signals sent from a crank angle sensor, an airflow meter, a cooling water temperature sensor, an accelerator opening sensor, etc., and controls the engine in accordance with the detected current engine operation condition. At the same time, based on the detected current engine operation condition, the control unit controls the rotational movement of the output shaft 13 of the electric motor 8. Under operation of the electric motor 8, controlled current is fed to the coils 18 through the feeding brushes 31*a* and 31*b*, the slip rings 26*a* and 26*b*, the switching brushes 25*a* and 25*b* and the commutator 21. With this, the rotation phase of the intake camshaft 2 relative to the timing sprocket 1 is varied or controlled with the aid of the speed reduction mechanism 12.

As is seen from FIGS. 1, 4 and 5, the speed reduction mechanism 12 comprises the eccentric shaft part 39 that carries out an eccentric rotation, a medium ball bearing 47 that is disposed on the eccentric shaft part 39, the rollers 48 that are rotatably disposed on the medium ball bearing 47, the cylindrical holding part 41 that holds the rollers 48 while allowing radial movement of the rollers 48 and the follower member 9 that is integral with the cylindrical holding part 41.

As is seen from FIG. 5, the eccentric shaft part 39 of the motor output shaft 13 has a raised cam surface 39*a* whose shaft center "Y" is slightly shifted in a radial direction from the shaft center "X" of the motor output shaft 13.

As is seen from FIG. 1, the medium ball bearing 47 is arranged around the needle bearing 38 having the eccentric shaft part 39 put therebetween, and comprises an inner race 47*a*, an outer race 47*b* and a plurality of balls rotatably disposed between the inner and outer races 47*a* and 47*b*. The inner race 47*a* is tightly disposed on the outer cylindrical wall of the eccentric shaft part 39.

While, as is seen from FIGS. 1 and 4, the outer race 47*b* is surrounded and held by the rollers 48 that is held by the above-mentioned apertured cylindrical holding part 41 of the follower member 9. As is seen from FIG. 1, radially outer portions of the rollers 48 are surrounded by the internal gear construction 19 of the timing sprocket 1. More specifically, the outer race 47*b* is axially moveable by a distance corresponding to a fine space C1 provided between a rear end of the outer race 47*b* and the bottom of the internal gear construction 19. Furthermore, around an outer cylindrical surface of the outer race 47*b*, there is defined an annular fine space C2 through which the entire construction of the medium ball bearing 47 can be shifted in a radial direction in accordance with the rotation of the eccentric shaft part 39.

The rollers 48 are constructed of iron-based metal, and as will be understood from FIG. 4, the rollers 48 are engaged with the wave-form teeth 19*a* of the internal gear construction 19. In operation, the rollers 48 engaged with the teeth 19*a* and received in the roller holding holes 41*b* are swung in a radial direction while being guided by roller holding holes 41*b*.

Into the speed reduction mechanism 12, there is fed a lubrication oil by a lubrication oil feeding system. As is seen from FIG. 1, the lubrication oil feeding system comprises an oil feeding passage (not shown) that is formed in the bearing 102 of the cylinder head 101 and fed with the lubrication oil from a main oil gallery, an oil passage 62 that is formed in the intake camshaft 2 and connected with the oil feeding passage through an opening 62*a*, a smaller diameter oil passage 63 that is formed in the follower member 9 and has one end connected to the oil passage 62 through an annular groove 62*b* and the other end exposed to a position near both the needle bearing 38 and the medium ball bearing 47 and an oil discharging passage (not shown) formed in the follower member 9.

Due to function of the lubrication oil feeding system, the speed reduction mechanism 12 is fed with the lubrication oil and thus, the medium ball bearing 47 and the rollers 48 are lubricated and at the same time, the needle bearing 38 and the smaller diameter ball bearing 37 are also lubricated.

The chain case 6 is integrally constructed of aluminum alloy or the like. As is seen from FIGS. 1 to 3, particularly, FIG. 3, the chain case 6 comprises the front wall 6*a* that is thicker and so sized as to cover a timing chain (not shown) that extends between a drive sprocket of the crank shaft and the timing sprocket 1 and a side wall 6*b* that extends along a periphery of the front wall 6*a*. As is seen from FIG. 1, the side wall 6*b* is fixed to the cylinder head 101 and the cylinder block.

As is best shown in FIG. 3, the front wall 6*a* is formed with the circular opening 55 into which a front part of the electric motor 8 is received. As is seen from FIGS. 1 and 3, the circular opening 55 comprises a larger diameter part 55*a* provided at a front side, a smaller diameter part 55*b* provided at a rear side and a stepped part 55*c* provided between the larger and smaller diameter parts 55*a* and 55*b*.

As is seen from FIG. 1, the front part (or cylindrical housing body 5*a*) of the electric motor 8 is concentrically received in the circular opening 55 of the front wall 6*a* of the chain case 6 leaving an annular space C therebetween. A front end 55*x* of the larger diameter part 55*a* is tapered for smoothing insertion of an after-mentioned annular oil seal 58 into a given position of the circular opening 55.

Between an inner cylindrical wall of the larger diameter part 55*a* of the circular opening 55 and an outer cylindrical wall of the front part of the cylindrical housing body 5*a* of the motor housing 5, there is intimately disposed the annular oil seal 58.

It is to be noted that this annular oil seal 58 is inserted into the given position of the circular opening 55 from the front open side of the chain case 6. Thus, a front side of the annular oil seal 58 set in the given position can be entirely viewed by eyes of an assembly worker when the circular cover member 4 is kept removed or dismantled from the chain case 6.

The annular oil seal 58 is constructed of synthetic rubber and has a generally C-shaped cross section as shown. More specifically, the annular oil seal 58 comprises a larger diameter outer part 58*a* that is press-fitted onto the inner cylindrical wall 55*a* of the circular opening 55 of the chain case 6, a smaller diameter inner seal lip part 58*b* that is slidably pressed on the outer cylindrical wall of the housing body 5*a* of the motor housing 5 and an annular wall part 5*c* through which the outer and inner parts 5*a* and 5*b* are connected.

Although not shown in the drawings, the larger diameter outer part 58*a* of the annular oil seal 58 has a reinforcing core member embedded therein. With this reinforcing core member, the larger diameter outer part 58*a* can be tightly pressed onto the inner cylindrical wall 55*a* of the circular opening 55 of the chain case 6 while being positioned by the stepped part 55*c* of the circular opening 55 of the front part 6*a* of the chain case 6.

As is seen from FIG. 1, due to provision of an annular back-up spring 59, the smaller diameter inner seal lip part 58*b* of the annular oil seal 58 can be assuredly pressed onto the outer cylindrical wall of the housing body 5*a* of the motor housing 5. Due to provision of the lip part of the smaller diameter inner seal lip part 58*b*, oil sealing performance of the oil seal 58 is improved.

As has been mentioned hereinabove, upon assembly, the chain case 6 is connected to front ends of the cylinder head 101 and the cylinder block by using connecting bolts.

It is however to be noted that before the connection of the chain case 6 to the cylinder head 101 and the cylinder block, the annular oil seal 58 should be properly set in the given position.

When thereafter the chain case 6 is connected to the cylinder head 101 and the cylinder block, the front part of the electric motor 8 previously mounted to the intake camshaft 2 is inserted into the circular opening 55 of the chain case 6 from the inside. During insertion of the front part of the electric motor 8 into the given position of the circular opening 55, the smaller diameter inner seal lip part 58*b* of the annular oil seal 58 previously set in the larger diameter part 55*a* of the circular opening 55 is forced to slide on the outer cylindrical wall of the cylindrical housing body 5*a* by a given distance.

As has been mentioned hereinabove, before the circular cover member 4 is mounted to the chain case 6, the annular oil seal 58 can be viewed by the eyes of the assembly worker and thus he or she can easily check whether the annular oil seal 58 is properly set in the given position or not. If not, he or she can fix the position or condition of the annular oil seal 58 with ease.

When checking of the annular oil seal 58 is finished, the circular cover member 4 is fixed to the front wall 6*a* of the chain case 6 as will be understood from FIG. 3. More specifically, for this fixing, the circular cover member 4 is placed onto the front wall 6*a* of the chain case 6 while receiving positioning pins 6*x* and 6*x* of the front wall 6*a* of the chain case 6 into positioning holes 28*l* and 28*l* of the cover member 4. With this step, positioning of the cover member 4 relative to the chain case 6 is established. Then, the four connecting bolts 57 are passed through the bolt holes 28*d* of the cover member 4 and engaged with the threaded holes 55*d* of the front wall of the chain case 6. With these steps, the circular cover member 4 can be neatly fixed to the front wall 6*a* of the chain case 6 as will be understood from FIGS. 2 and 3.

In the following operation of the valve timing control device of the first embodiment of the present invention will be described with the aid of the accompanying drawings.

When, in response to rotation of the crankshaft of an associated internal combustion engine (not shown), the timing sprocket 1 (see FIG. 1) is turned by a timing chain (not shown) extending from the crankshaft, the motor housing 5 of the electric motor 8 is synchronously turned through the internal gear construction 19 and a female screw construction. The rotation of the internal gear construction 19 is transmitted to the intake camshaft 2 though the rollers 48, the cylindrical holding part 41 and the follower member 9. Due to rotation of the intake camshaft 2, cams (not shown) on the intake camshaft 2 operate to open and close the intake valves (not shown) of the engine.

In a certain operation condition of the engine, due to control by the control unit, the coils 18 of the electric motor 8 are energized through the terminal members 33*a* and 33*a*, the pig-tail harnesses 31*d* and 31*e*, the feeding brushes 31*a* and 31*b* and the slip rings 26*a* and 26*b*. Upon this, the motor output shaft 13 is turned. The turning of the motor output shaft 13 varies a rotation phase of the intake camshaft 2 relative to that of the timing sprocket 1 through the speed reduction mechanism 12.

That is, when, in response to rotation of the motor output shaft 13, the eccentric shaft part 39 makes an eccentric rotation, 41*b* of the rollers 48, which are rotatably held in the roller holding holes 41*b* of the follower member 9 and engaged with the wave-form teeth 19*a* of the internal gear construction 19 (see FIG. 4), are forced to shift to the next wave-form teeth 19*a* riding over the present wave-form teeth 19*a* each time the motor output shaft 13 makes one turn. This teeth shifting of the rollers 48 is continued until stopping of the rotation of the motor output shaft 13, and finally the rollers 48 are shifted to the desired wave-form teeth 19*a* establishing a new (or desired) relative rotational angle between the follower member 9 and the timing sprocket 1. This means that the rotational phase of the follower member 9 (or intake camshaft 2) is advanced or retarded relative to the timing sprocket 1.

As will be understood from FIGS. 4 and 6, abutting of the projected stopper 61*d* of the annular holding plate 61 (see FIG. 4) with either one of the opposed ends 2*c* and 2*d* of the curbed stopper recess 2*b* of the intake camshaft 2 establishes the maximum advanced or maximum retarded rotational phase of the intake camshaft 2 relative to the timing sprocket 1.

Accordingly, the open/close timing of the intake valves is controlled by the control unit with the aid of the above-mentioned rotational phase varying mechanism.

When in response to rotation of the motor output shaft 13, the detected unit 50 of the rotation angle sensor 35 is rotated, an induction current is produced in the detecting unit 51. By processing the induction current, the control unit detects the rotation angle of the motor output shaft 13. By monitoring the rotation angle of the motor output shaft 13 and the rotational position of the crankshaft of the engine, the control unit controls the electric motor 8 to establish a desired rotational phase of the intake camshaft 2.

In the following, advantageous features of the present invention will be described.

As has been mentioned hereinabove, in the present invention, before the circular cover member 4 is mounted to the chain case 6, the annular oil seal 58 can be viewed by eyes of an assembly worker and thus he or she can easily check whether the annular oil seal 58 is properly set in the given position or not. With this checking, undesired oil leakage caused by incomplete setting of the annular oil seal 58 in the given position is assuredly avoided. That is, as is seen from FIG. 1, oil leakage from the area of the timing sprocket 1 to the interior of the electric motor 8 can be avoided.

Due to provision of the stepped part 55*c* (see FIGS. 1 and 3) of the circular opening 55 of the chain case 6, positioning of the annular oil seal 58 in the circular opening 55 can be easily and assuredly made.

As will be seen from FIG. 4, the power feeding connector 33 and the signal connector 34 are arranged to extend radially outward from the circular cover body 38 of the cover member 4, and thus the construction of the cover member 4 can be made thin in shape. This thin shape of the cover member 4 brings about reduction in axial size of the valve timing control device of the present invention.

As is seen from FIG. 1, the circular cover body 28 of resin has the reinforcing metal plates 28*a* embedded therein. Thus, mechanical strength of the circular cover body 28 is increased. Due to the increased mechanical strength of the cover body 28, when the cover member 4 is fixed to the front wall 6*a* of the chain case 6, the portion of the front wall 6*a* of the chain case 6 (see FIG. 3) where the circular opening 55 is formed can have an increased mechanical strength, and thus, the electric motor 8 installed in the circular opening 55 can exhibit assured rotational operation without producing undesired vibration. This brings about an assured rotation of the detected unit 50 of the rotation angle sensor 35 about its axis relative to the detecting unit 51, which improves the performance of the rotation angle sensor 35.

As is seen from FIGS. 1 and 4, the leading end part 50*b* of the detected unit 50 is received in the annular groove 36*a* causing the honewort-shaped rotor 52 of the detected unit 50 to be positioned away from the two slip rings 26*a* and 26*b* in an axial direction. This arrangement prevents the rotor 52 from a metal powder that would be produced when the slip rings 26*a* and 26*b* slide on the tops of the power feeding brushes 31*a* and 31*b*.

Furthermore, since the annular grooves 36*a* and 36*b* constitute a labyrinth groove, the metal powder, which would be produced due to sliding of the slip rings 26*a* and 26*b* on the tops of the power feeding brushes 31*a* and 31*b*, is suppressed from moving to the leading end part 50*b* of the detected unit 50. This promotes increase in performance of the rotation angle sensor 35.

Second Embodiment

In the following, a valve timing control device of a second embodiment of the present invention will be described with reference to FIGS. 9 to 11.

For ease of understanding, substantially same elements as those used in the above-mentioned first embodiment will be denoted by the same numerals in the second embodiment. Detailed explanation of such same elements will be omitted for ease of description.

In this second embodiment, in addition to the phase varying mechanism 3 for the intake valves employed in the above-mentioned first embodiment, another phase varying mechanism 71 for exhaust valves is employed. The phase varying mechanism 71 for exhaust valves is of hydraulic type that is hydraulically powered.

Figure 9:
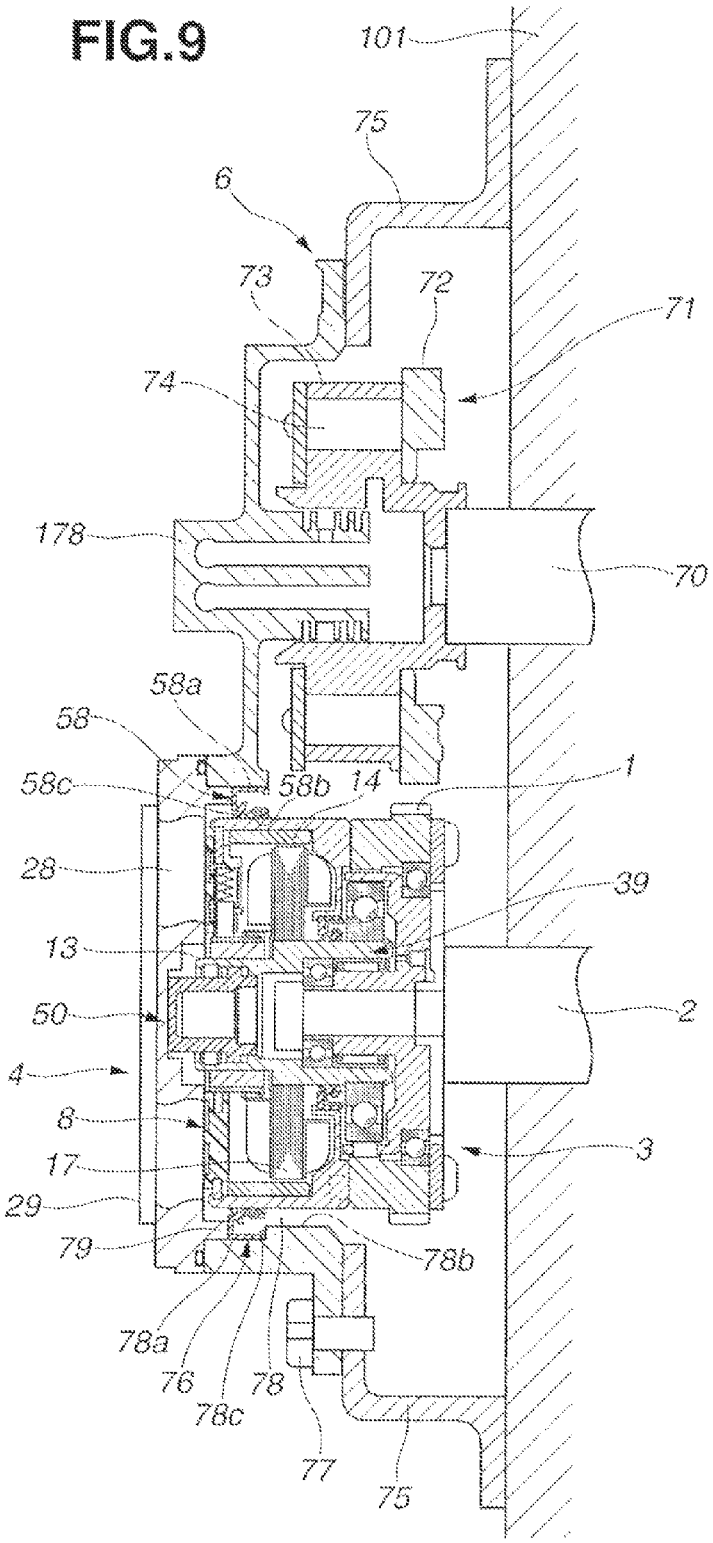
FIG. 9 is a sectional view of a valve timing control device of a second embodiment of the present invention.
Figure 10:
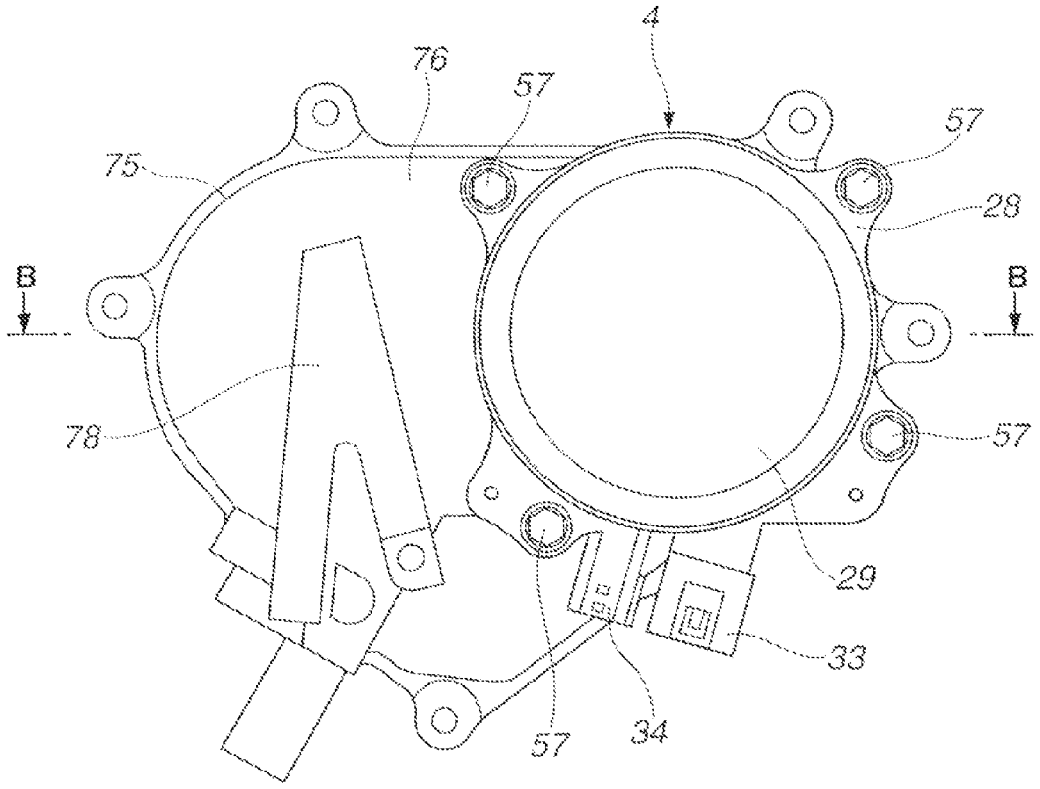
FIG. 10 is a front view of the valve timing control device of the second embodiment, showing a chain case and a cover member.

As is seen from FIG. 9, the phase varying mechanism 71 is arranged at a front position of an exhaust camshaft 70.

It is to be noted that the phase varying mechanism 71 is substantially the same as that described in Japanese Laid-open Patent Application (tokkai) 2013-147934.

Denoted by numeral 72 is timing a sprocket that is driven by a crankshaft of the engine through a timing chain. Actually, the timing chain is applied to both the timing sprocket 1 for the intake valves as well as the timing sprocket 72 for the exhaust valves.

Figure 11:
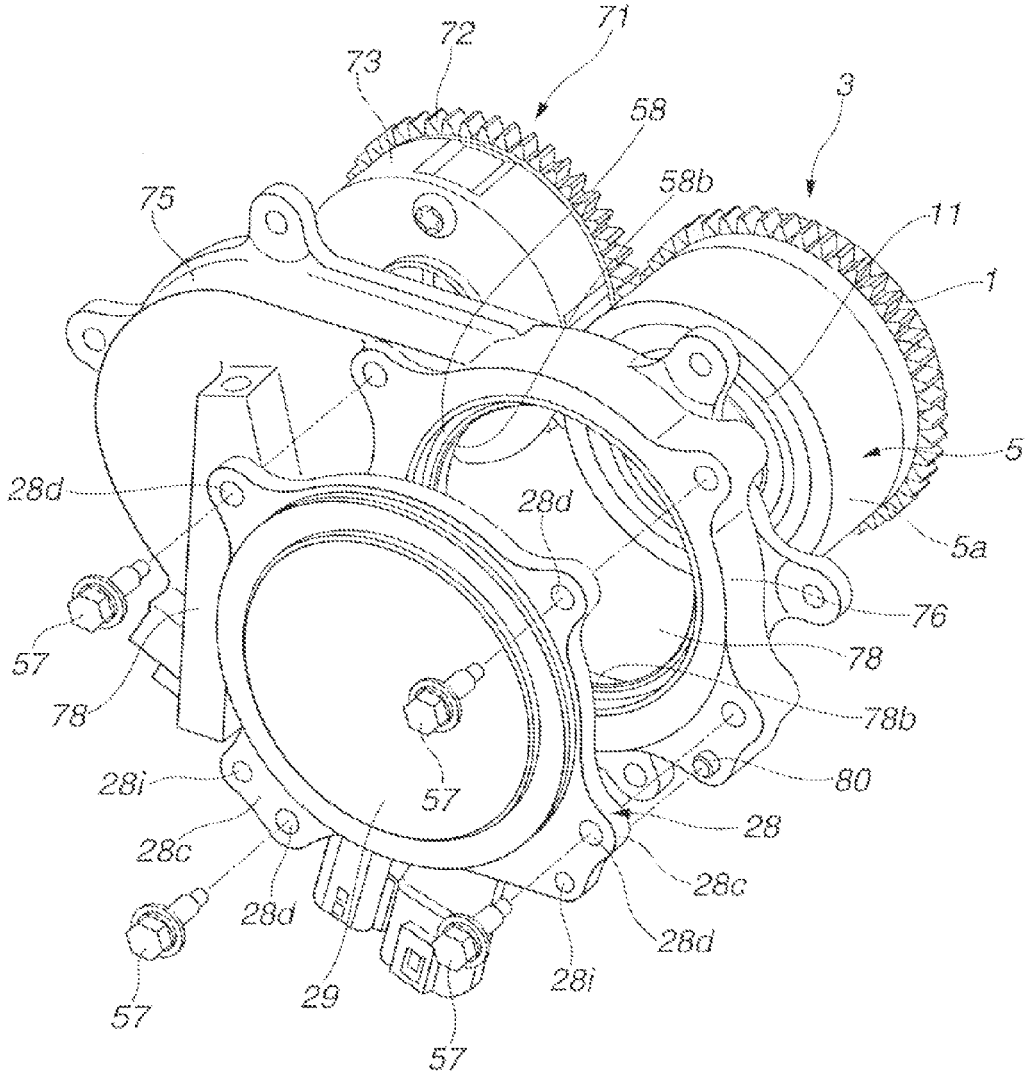
FIG. 11 is an exploded perspective view of a unit of valve timing control device of the second embodiment, which includes the chain case, the cover member, an intake side phase varying mechanism and an exhaust side phase varying mechanism.

As seen from FIGS. 9 and 11, within a cylindrical housing 73 connected to the timing sprocket 72, there is rotatably installed a vane rotor 74 to which a front end of the exhaust camshaft 70 is fixed. Between the housing 73 and the vane rotor 74, there are provided and advancing hydraulic chamber and a retarding hydraulic chamber or the retarding hydraulic chamber with a hydraulic pressure from a hydraulic circuit, the rotation phase of the exhaust camshaft 70 is advanced or retarded relative to the timing sprocket 72.

Denoted by numeral 6 is a chain case having a case part 76 that is connected to the cylinder head 101 through brackets 75 and 76 and connecting bolts 77, as shown. The case part 76 has at an exhaust side thereof hydraulic passages 178 that constitute part of the hydraulic circuit, and at an intake side thereof a circular opening 78 that receives therein the housing of 5*a* of the electric motor 8. Between an inner cylindrical wall of the circular opening 78 and an outer cylindrical wall of the housing body 5*a* of the electric motor 8, there is operatively fitted an annular oil seal 58.

Since the annular oil seal 58 is substantially the same as the oil seal 58 mentioned in the above-mentioned first embodiment, details of the oil seal 58 will be omitted.

Furthermore, since the circular opening 78 of the case part 76 is substantially the same as the circular opening 55 mentioned in the first embodiment, details of the circular opening 78 will be omitted. That is, like in the first embodiment, the circular opening 78 comprises a larger diameter portion 78*a*, a smaller diameter portion 78*b* and a stepped part 78*c* defined between the larger and smaller diameter portions 78*a* and 78*b*.

As is seen from FIG. 9, a cover body 28 of a circular cover member 4 has at its rear end an annular ridge 79 press-fitted onto the inner cylindrical wall of the larger diameter portion 78*a* of the circular opening 78.

In assembling process, after the phase varying mechanisms 3 and 71 are connected to the intake and exhaust camshafts 2 and 70 respectively, the chain case 6 is brought to and then fixed to the cylinder head 101 together with the brackets 75. During this, the seal part 58*b* and seal lip 58*c* of the annular oil seal 58 previously set in the larger diameter portion 78*a* of the circular opening 78 are forced to slide axially on the outer cylindrical wall of the housing body 5*a* of the electric motor 8.

Accordingly, also in the second embodiment, before mounting the cover member 4 to the chain case 6, the setting state of the annular oil seal 58 can be easily checked by visual inspection from the outside.

As is seen from FIG. 11, the case part 76 of the chain case 6 is formed with positioning pins 80 that are mated with positioning openings 28*l* of the cover member 4 for establishing positioning between the chain case 6 and the cover member 4.

In the above description, it is described that the annular oil seal 58 is arranged between the outer cylindrical wall of the housing body 5*a* of the electric motor 8 and the inner cylindrical wall of the circular opening 55 of the chain case 6. However, if desired, the annular oil seal 58 may be arranged between the outer cylindrical wall of the housing body 5*a* of the electric motor 8 and an inner cylindrical wall of a circular opening (not shown) formed in the cylinder head 101. In this case, the front part of the electric motor 8 is received in the circular opening of the cylinder head 101.

The entire contents of Japanese Patent Application 2014-173699 filed Aug. 28, 2014 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve timing control device of an internal combustion engine, comprising:

first and second rotational members;

a phase varying mechanism that varies a rotation phase of the second rotational member relative to the first rotational member;

an electric motor mounted to the first rotational member;

a speed reduction mechanism through which rotation of an output shaft of the electric motor is transmitted to the second rotational member while reducing the speed of the rotation;

a cover member covering at least a part of the electric motor and fixed to a given element of the engine, the given element being either one of a cylinder head of the engine and a chain case; and an annular seal member sealing an annular clearance between an outer cylindrical wall of the electric motor and the given element, the annular seal member being concealed by the cover member when the cover member is fixed to the given element;

wherein the cover member is constructed and arranged to cause the annular seal member to be exposed to the outside for a visual inspection of the annular seal member when the cover member is removed from the given element.

2. A valve timing control device of an internal combustion engine as claimed in claim 1, in which the cover member is constructed and arranged to cause an inner sealing portion of the annular seal member to be exposed to the outside for the visual inspection of the annular seal member when the cover member is removed from the given element.

3. A valve timing control device of an internal combustion engine as claimed in claim 2, in which the annular seal member comprises an outer annular part that is fixed to the given element and an inner annular part that slidably contacts with the outer cylindrical wall of the electric motor.

4. A valve timing control device of an internal combustion engine as claimed in claim 3, in which the annular seal member has a generally C-shaped cross section and has at the inner annular part thereof a seal lip that slidably contacts with the outer cylindrical wall of the electric motor.

5. A valve timing control device of an internal combustion engine as claimed in claim 3, in which the given element is formed with a circular opening in which a front part of the electric motor is received, and in which an inner cylindrical surface of the circular opening is formed with a stepped part against which the outer annular part of the annular seal member abuts in an axial direction.

6. A valve timing control device of an internal combustion engine as claimed in claim 2, in which an intermediate member is disposed between the cover member and the given element and formed with a circular opening, and in which an outer annular part of the annular seal member is fixed to an inner cylindrical wall of the circular opening and an inner annular part of the annular seal member slidably contacts with the outer cylindrical wall of the electric motor.

7. A valve timing control device of an internal combustion engine as claimed in claim 6, in which the cover member, the intermediate member and the given element are entirely positioned by positioning pins.

8. A valve timing control device of an internal combustion engine as claimed in claim 2, in which the annular seal member is arranged at a front part of the electric motor where the cover member is placed.

9. A valve timing control device of an internal combustion engine, comprising:

first and second rotational members;

a phase varying mechanism that varies a rotation phase of the second rotational member relative to the first rotational member thereby to change an operating characteristic of engine valves;

an electric motor mounted to the first rotational member;

a speed reduction mechanism through which rotation of an output shaft of the electric motor is transmitted to the second rotational member while reducing the speed of the rotation;

a fixing member having a circular opening in which a cylindrical housing of the electric motor is inserted;

a cover member covering one open side of the circular opening while concealing part of the electric motor; and an annular seal member having an outer annular part that is fixed to an inner cylindrical wall of the circular opening of the fixing member and an inner annular part that slidably contacts with an outer cylindrical wall of the cylindrical housing of the electric motor, wherein a diameter of the inner annular part of the annular seal member is smaller than a diameter of the one open side of the circular opening of the fixing member.

10. A valve timing control device of an internal combustion engine as claimed in claim 9, in which the fixing member is either one of a cylinder head of the engine and a chain case.

11. A valve timing control device of an internal combustion engine as claimed in claim 9, in which the fixing member is a cover member used for a hydraulic type valve timing control device.

12. A valve timing control device of an internal combustion engine comprising:

intake and exhaust camshafts arranged to extend in parallel with each other;

an electric type phase varying mechanism coaxially connected to the intake camshaft; and a hydraulic type phase varying mechanism coaxially connected to the exhaust camshaft, wherein the electric type phase varying mechanism comprises:

an intake side driving rotational member to which a torque of crankshaft of the engine is transmitted;

an intake side follower rotational member that is integrally connected to the intake shaft;

an electric motor that is integrally mounted to the intake side driving rotational member and has a motor output shaft by which the intake side follower rotational member is rotated relative to the intake side driving rotational member;

a fixing member having a circular opening in which a housing of the electric motor is received, the fixing member being arranged to cover the least part of the hydraulic type phase varying mechanism;

a cover member that is connected to the fixing member in a manner to cover one open end of the circular opening of the fixing member; and an annular seal member sealing an annular clearance between an outer cylindrical wall of the housing of the electric motor and a cylindrical inner wall of the circular opening of the fixing member;

wherein when the cover member is removed from the fixing member, the annual seal member is exposed to the outside through the opening end of the circular opening of the fixing member for a visual inspection of the annular seal member.

* * * * *